US010400523B1

(12) United States Patent
Hunt

(10) Patent No.: US 10,400,523 B1
(45) Date of Patent: Sep. 3, 2019

(54) DRILL COIL AND METHOD OF COILED TUBE DRILLING

(71) Applicant: Google Inc., Mounatin View, CA (US)

(72) Inventor: Thomas Hunt, Oakland, CA (US)

(73) Assignee: Google LLC, Mountain View, CA (US)

( * ) Notice: Subject to any disclaimer, the term of this patent is extended or adjusted under 35 U.S.C. 154(b) by 288 days.

(21) Appl. No.: 15/295,364

(22) Filed: Oct. 17, 2016

Related U.S. Application Data

(60) Provisional application No. 62/245,571, filed on Oct. 23, 2015.

(51) Int. Cl.

| | |
|---|---|
| ***E21B 47/12*** | (2012.01) |
| ***E21B 7/04*** | (2006.01) |
| ***E21B 17/20*** | (2006.01) |
| ***E21B 17/00*** | (2006.01) |
| ***E21B 7/06*** | (2006.01) |
| *E21B 7/02* | (2006.01) |
| *E21B 47/024* | (2006.01) |

(52) U.S. Cl.
CPC ..... *E21B 17/206* (2013.01); *E21B 7/046* (2013.01); *E21B 7/06* (2013.01); *E21B 17/003* (2013.01); *E21B 7/02* (2013.01); *E21B 47/024* (2013.01)

(58) Field of Classification Search
CPC ..... E21B 47/12; E21B 17/028; E21B 17/003; E21B 7/04
See application file for complete search history.

(56) References Cited

U.S. PATENT DOCUMENTS

| | | | | |
|---|---|---|---|---|
| 4,858,704 | A | 8/1989 | McDonald et al. | |
| 6,392,317 | B1 | 5/2002 | Hall et al. | |
| 6,536,539 | B2 * | 3/2003 | Merecka | E21B 7/04 175/203 |
| 7,025,142 | B2 | 4/2006 | Crawford | |
| 7,195,082 | B2 | 3/2007 | Adam et al. | |
| 2013/0176137 | A1 | 7/2013 | Kolpack et al. | |
| 2013/0176139 | A1 | 7/2013 | Chau et al. | |
| 2016/0010436 | A1 * | 1/2016 | Boyd | E21B 43/121 166/105 |

FOREIGN PATENT DOCUMENTS

| | | |
|---|---|---|
| WO | WO-2013103976 A1 | 7/2013 |
| WO | WO-2014159293 A1 | 10/2014 |

* cited by examiner

*Primary Examiner* — Catherine Loikith
(74) *Attorney, Agent, or Firm* — Honigman LLP

(57) ABSTRACT

A drill coil includes a drill tube, a fluid conduit, a power or communication line, and at least one of a communication wire or a power line. The drill tube defines a longitudinal axis and includes a tubular wall forming a drill tube lumen along the longitudinal axis. The tubular wall defines at least one utility lumen along the longitudinal axis. The power or communication line is disposed in the at least one utility lumen. The fluid conduit is housed in the drill tube lumen and extends along the longitudinal axis and configured to convey a fluid therethrough. The at least one of the communication wire or the power line is housed in the drill tube lumen adjacent the fluid conduit.

18 Claims, 11 Drawing Sheets

DRILL COIL AND METHOD OF COILED TUBE DRILLING

CROSS REFERENCE TO RELATED APPLICATIONS

This U.S. patent application claims priority under 35 U.S.C. § 119(e) to U.S. Provisional Application 62/245,571, filed on Oct. 23, 2015, which is hereby incorporated by reference in its entirety.

TECHNICAL FIELD

This disclosure relates to coiled tube horizontal drilling.

BACKGROUND

Directional drilling or boring is generally used for installing infrastructure, such as telecommunications and power cable conduits, water lines, sewer lines, gas lines, oil lines, product pipelines, and environmental remediation casings. Directional drilling allows crossing waterways, roadways, shore approaches, congested areas, environmentally sensitive areas, and areas where other methods are costlier or not possible. The technique has extensive use in urban areas for developing subsurface utilities as it helps in avoiding extensive open cut trenches. The use may require that the operator have complete information about existing utilities so that he/she can plan the alignment to avoid damaging those utilities.

In general, a pipeline can be installed with a directional drilling apparatus under a barrier, such as highway, road, waterway, building, or other surface obstruction without disturbing the barrier. Installation of the pipeline under the barrier typically entails drilling a hole under the barrier and then advancing a pipeline section through the hole.

SUMMARY

The disclosure describes a drill coil that includes a drill tube defining a longitudinal axis and having a tubular wall forming a drill tube lumen along the longitudinal axis. The drill tube lumen houses a fluid conduit configured to convey a fluid, such as a drilling fluid, therethrough. The drill tube lumen may also house one or more cables or wires, such a power line, a communication wire, or a power/communication wire (e.g., power over Ethernet). The drill tube lumen may house other optional components as well, such as push rods, a hydraulic fluid pressure line, a return line or other components that facilitate directional drilling.

One aspect of the disclosure provides a drill coil. The drill coil includes a drill tube, a power or communication line, a fluid conduit, and at least one of a communication wire or a power line. The drill tube defines a longitudinal axis and includes a tubular wall forming a drill tube lumen along the longitudinal axis. The tubular wall defines at least one utility lumen along the longitudinal axis. The drill tube has a first end releasably connectable to a drill bit having a sensor and a second end releasably connected to a drill rig. The power or communication line is disposed in the at least one utility lumen. The fluid conduit is housed in the drill tube lumen and extends along the longitudinal axis. The fluid conduit is configured to convey a fluid therethrough. The at least one of a communication wire or a power line is housed in the drill tube lumen adjacent the fluid conduit. The communication wire is configured to provide communication between the sensor of the drill bit and the drill rig. The power line is configured to deliver power from the drill rig to the drill bit. In some examples, the power line is a hydraulic power line, which delivers hydraulic power, rather than electric power.

Implementations of the disclosure may include one or more of the following optional features. In some implementations, the drill lube lumen houses additional components. For example, one or more of at least one push rod, a hydraulic pressure line, or a return line may be housed in the drill tube lumen adjacent the fluid conduit. The at least one push rod may have a first end connected to the first end of the drill tube. The tubular wall may have an outer radius and an inner radius. The fluid conduit may have an outer radius, and wherein the at least one push rod, the communication wire, and the power line, each has a cross-sectional width along the inner radius of the tubular wall. The inner radius of the tubular wall may be greater than the outer radius of the fluid conduit plus a largest of the cross-sectional width of any of the at least one push rod, the communication wire, and the power line.

In some examples, the tubular wall has an inner surface defining a longitudinal track that receives and guides movement of the at least one push rod. Additionally or alternatively, the at least one push rod may define a longitudinal recess having a shape complimentary to the longitudinal track. Moreover, the tubular wall may also define a longitudinal recess configured to receive and guide movement of the at least one push rod (e.g., via a push rod track **204*t***). The at least one push rod may define a longitudinal track having a shape complimentary to the longitudinal recess. At least one push rod may include a steel material or a pultruded composite material.

In some implementations, at least one support is housed in the drill tube lumen and extend along the longitudinal axis. The support may support the fluid conduit and the at least one of the communication wire or the power line. The drill coil may also include a power/communication conduit housed in the drill tube lumen adjacent the fluid conduit. The power/communication conduit may house the at least one of the communication wire or the power line.

The tubular wall may have an outer diameter between 25 millimeters and 102 millimeters. The fluid conduit may have an outer diameter between about between 25 millimeters and 51 millimeters. The power/communication conduit may have an outer diameter between about 10 millimeters and 50 millimeters. Moreover, the communication wire may include an optical fiber for transmitting an optical communication. In some examples, the drill tube lumen houses hydraulic pressure and/or return lines.

Another aspect of the disclosure provides a drill coil. The drill coil includes a drill tube, a fluid conduit, and at least one of a communication wire or a power line. The drill tube defines a crescent cross-sectional shape and a longitudinal axis. The drill tube includes a first wall and a second wall. The first wall defines a first curved shape having a first radius of curvature. The second wall defines a second curved shape having a second radius of curvature less than the first radius of curvature. The first and second walls are joined and collectively form a drill tube lumen having a crescent cross-sectional shape along the longitudinal axis. The drill tube has a first end releasably connectable to a drill bit having a sensor and a second end releasably connectable to a drill rig. The second wall defines a longitudinal recess of the drill tube having a partially circular cross-section and configured to receive and releasable retain a conduit. The fluid conduit is housed in the drill tube lumen and extends along the longitudinal axis. The fluid conduit is configured to convey a fluid therethrough. The at least one of the communication wire or the power line is housed in the drill tube lumen adjacent the fluid conduit. The communication wire is configured to provide communication between the sensor of the drill bit and the drill rig. The power line is configured to deliver power from the drill rig to the drill bit.

This aspect may include one or more of the following optional features. In some implementations, the drill coil includes at least one push rod housed in the drill tube lumen adjacent the fluid conduit. The at least one push rod has a first end connected to the first end of the drill tube. The first wall may define a passage for receiving the conduit.

Yet another aspect of the disclosure provides a method of drilling. The method includes unspooling a coiled drill tube from a spool on a drill rig, advancing the drill tube into a first ground surface of earth, and navigating the drill tube in the earth to exit a second ground surface of the earth. The drill tube includes a drill tube, a power or communication line, a fluid conduit, and at least one of a communication wire or a power line. The drill tube defines a longitudinal axis and includes a tubular wall forming a drill tube lumen along the longitudinal axis. The tubular wall defines at least one utility lumen along the longitudinal axis. The drill tube has a first end releasably connectable to a drill bit having a sensor and a second end releasably connectable to a drill rig. The power or communication line is disposed in the at least one utility lumen. The fluid conduit is housed in the drill tube lumen and extends along the longitudinal axis. The fluid conduit is configured to convey a fluid therethrough. The at least one of a communication wire or a power line is housed in the drill tube lumen adjacent the fluid conduit. The communication wire is configured to provide communication between the sensor of the drill bit and the drill rig. The power line is configured to deliver power from the drill rig to the drill bit. In some examples, the power line is a hydraulic power line, which delivers hydraulic power, rather than electric power.

This aspect may include one or more of the following optional features. In some implementations, navigating the drill tube includes manipulating at least one push rod housed in the drill tube lumen adjacent the fluid conduit. The at least one push rod may have a first end connected to the first end of the drill tube. The tubular wall may have an outer radius and an inner radius. The fluid conduit may have an outer radius, and wherein the at least one push rod, the communication wire, and the power line, each has a cross-sectional width along the inner radius of the tubular wall. The inner radius of the tubular wall may be greater than the outer radius of the fluid conduit plus a largest of the cross-sectional width of any of the at least one push rod, the communication wire, and the power line. The tubular wall may have an inner surface defining a longitudinal track that receives and guides movement of the at least one push rod. The at least one push rod may define a longitudinal recess having a shape complimentary to the longitudinal track. The tubular wall may define a longitudinal recess configured to receive and guide movement of the at least one push rod. The at least one push rod may define a longitudinal track having a shape complimentary to the longitudinal recess.

In some examples, the at least one push rod includes a steel material or a pultruded composite material. The drill tube may also include at least one support housed in the drill tube lumen and extending along the longitudinal axis. The support may support the fluid conduit and the at least one of the communication wire or the power line. The drill tube may further include a power/communication conduit housed in the drill tube lumen adjacent the fluid conduit. The power/communication conduit may house the at least one of the communication wire or the power line.

In some examples, the tubular wall has an outer diameter between 25 millimeters and 102 millimeters. The fluid conduit may have an outer diameter between about between 25 millimeters and 51 millimeters. The power/communication conduit may have an outer diameter between about 10 millimeters and 50 millimeters. Moreover, the communication wire may include an optical fiber for transmitting an optical communication.

Yet another aspect of the disclosure provides a second method of drilling. The method includes unspooling a coiled drill tube from a spool, advancing the drill tube into a first ground surface of earth, and navigating the drill tube in the earth to exit a second ground surface of the earth. The drill tube includes a drill tube having a crescent cross-sectional shape and defining a longitudinal axis. The drill tube includes a first wall defining a first curved shape having a first radius of curvature and a second wall defining a second curved shape having a second radius of curvature less than the first radius of curvature. The first and second walls are joined and collectively form a drill tube lumen having a crescent cross-sectional shape along the longitudinal axis. The drill tube has a first end releasably connectable to a drill bit and a second end releasably connectable to the drill rig. The second wall defines a longitudinal recess of the drill tube having a partially circular cross-section and configured to receive and releasable retain a conduit. The drill tube also includes a fluid conduit housed in the drill tube lumen and extending along the longitudinal axis. The fluid conduit is configured to convey a fluid therethrough. The drill tube also includes at least one of a communication wire or a power line housed in the drill tube lumen adjacent the fluid conduit and the at least one push rod. The communication wire is configured to provide communication between a sensor of the drill bit and the drill rig. The power line is configured to deliver power from the drill rig to the drill bit.

This aspect may include one or more of the following optional features. In some implementations, navigating the drill tube comprises manipulating at least one push rod housed in the drill tube lumen adjacent the fluid conduit. The at least one push rod may have a first end connected to the first end of the drill tube.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
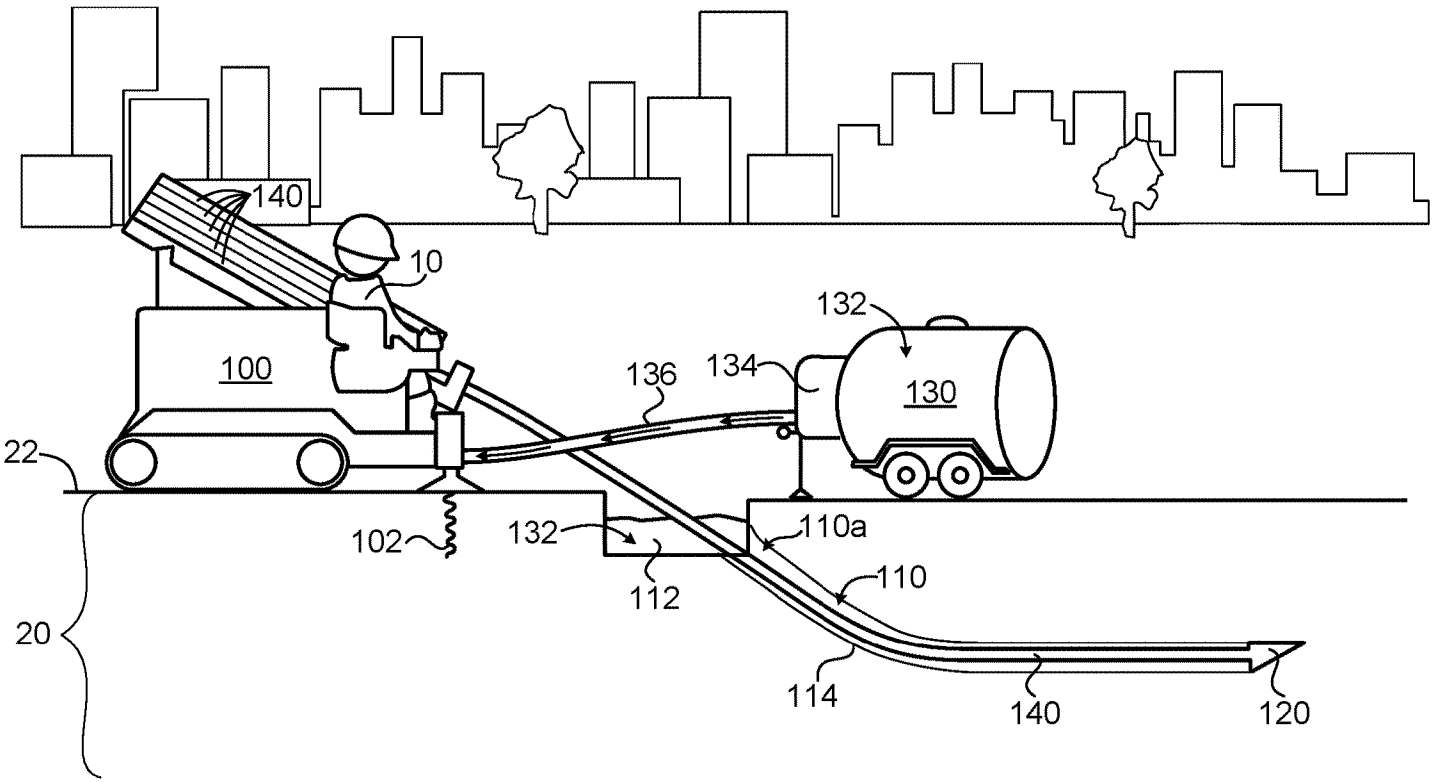
Prior Art FIG. 1
FIG. 1 is a schematic view illustrating drilling a pilot bore for installing a larger diameter section of pipe under a barrier, such as a roadway based on the prior art.

Referring to FIG. 1, directional boring, also known as horizontal directional drilling (HDD), is a steerable process for installing underground pipes and/or cables. HDD uses a surface launched drilling rig 100 that minimizes any impact on the area surrounding a drilling bore 110. HDD is used extensively for utility installations even when trenching and excavating is possible, because HDD minimizes ground and landscape disturbance. Moreover, HDD is often faster and cheaper than open trenching. As a result, HDD is employed for new utility installations in urban and suburban areas. A drill operator 10 operating the drill rig 100 starts by drilling a pilot bore 110 in a surface 22 of the earth 20 along a designated path. Often the pilot hole is sufficient for 4" and smaller utilities. Otherwise, next is a reaming process, which enlarges the hole by passing a larger cutting tool, known as a back reamer. Typically, the pilot hole 110 is dug from a first end 110*a* to a second end (not shown), and the reamer enlarges the bore 110 starting from the second end to the first end 110*a*. The reamer has a diameter that is usually larger than the pilot bore 110. In some examples, the reamer pulls back a pipe (not shown) through the bore 110. The diameter of the reamer is determined based on the diameter of the pipe that is being pulled back to the first end.

When drilling the pilot bore 110, drilling fluid, which is typically a mixture of water and bentonite or polymer is continuously pumped to the cutting head or drill bit 120 to aid in removing the cuttings, stabilizing the bore 110, cooling the drill bit 120, and lubricating the passage of the product pipe (i.e., the pipe the reamer pulls back from the second end to the first end 110*a*). A drilling fluid tank 130 holds the drilling fluid 132 and supplies the drilling fluid 132 to the drill rig 100 that allows the fluid 132 to flow through the pilot bore 110. The drilling fluid tank 130 includes a pump 134 that pumps the fluid 132 through a hose 136 connecting the fluid tank 130 to the drilling rig 100. In some implementations, the first end 110*a* of the bore 110 and the second end (not shown) of the bore 110 each includes a trench 112 pit for capturing the returned drilling fluid 132. In some examples, the drill rig 100 includes a drill anchor 102 that anchors the drill rig 100 into the earth 20 and prevents it from moving while drilling the bore 110.

Small tracked HDD rigs 100 may be used for drilling bores 110 for telecommunication utility construction in urban and suburban areas. The drill rig 100 pushes and rotates a drill pipe 140 (having about a 5 centimeter diameter and typically 3-5 meters long) into the earth 20 at a shallow angle along a drill path 114. The drill operator 10 navigates the drill bit 120 to follow the drill path 114 by rotating the asymmetric drill bit 120. When the 5 meter drill pipe 140 has reached full insertion into the earth 20, the drill operator 10 screws on another drill pipe segment 140 from the cartridge supported by the drill rig 100 and resumes drilling. The drill rig 100 is usually capable of about 100 meter shots. As shown, the drill rig 100 carries the drill pipes 140, which in some examples, each drill pipe is about 3-5 meters long. After exiting into a pit at the second end, the HDD rig 100 reverses the drilling process, pipe by pipe 140, pulling utility conduit(s) along with the drill string (which is formed from the multiple connecting drill pipes 140), which is then disassembled back into its individual drill pipes 140.

Figure 2:
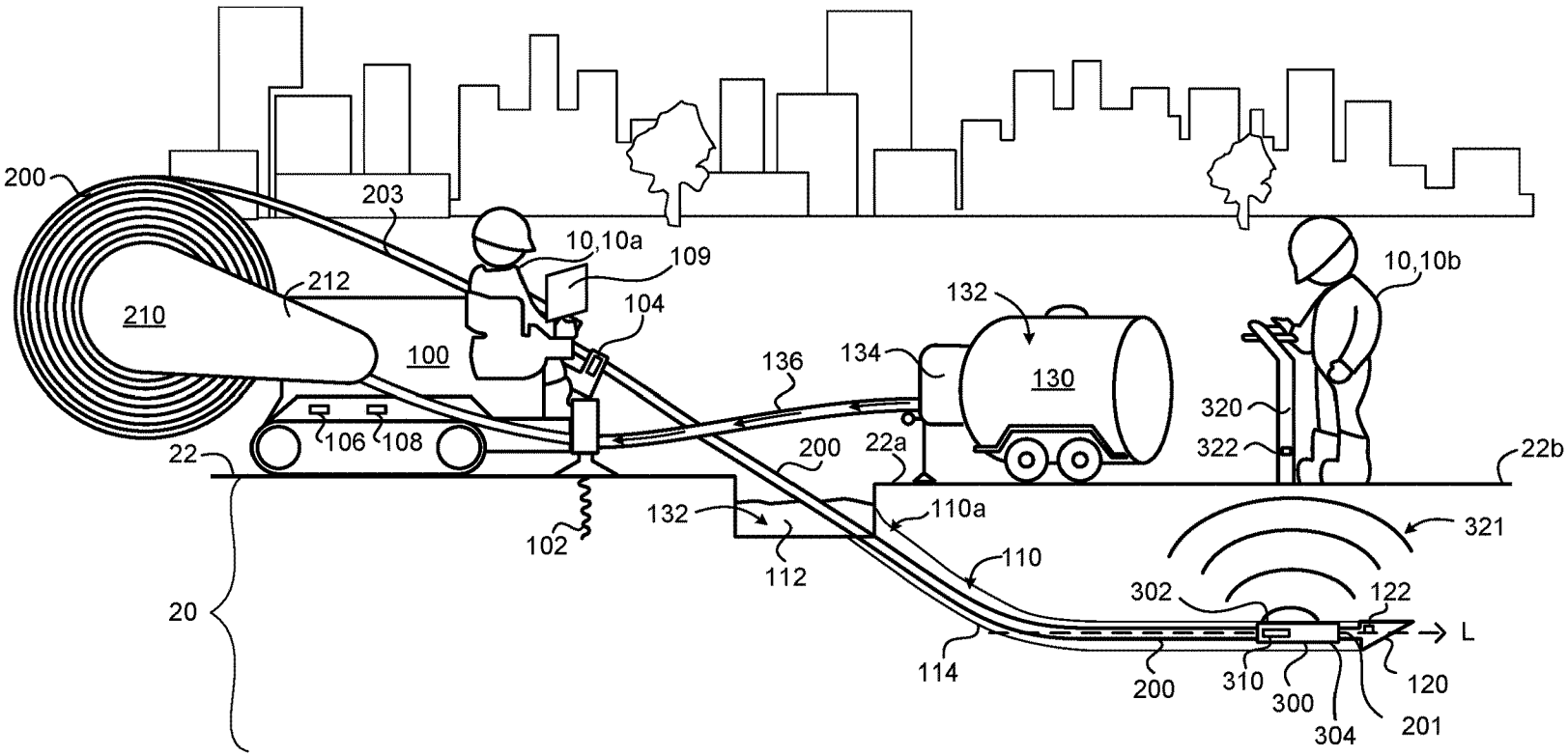
FIG. 2 is a schematic view illustrating drilling a pilot bore using example coiled tubing.

As described, the drilling process is expensive and time consuming. Therefore, it is desirable to have a system that is cost effective and takes less time. As shown in FIG. 2, replacing the drill pipes 140 that form a drill string with a coiled tube 200 reduces the time needed to drill and the labor, since the drilling operator 10 does not have to screw on/off each drilling rod, thus increasing operational efficiency. Moreover, replacing the drill pipes 140 that form the drill string with the coiled tube 200 allows remote operation of the drill rig 100 (i.e., without a walkover person at the actual drill site).

Referring to FIG. 2, the drill rig 100 supports a spool system 210 on which the coiled tube 200 is wound. The coiled tube 200 may be of composite tubing or polyethylene tubing, or steel tubing, or any other material capable of being spooled on a spool system 210. The drill rig 100 may be skid mounted in a frame or onto rails or a metal pallet. In this case, a fork lift positions the drill rig 100 on the frame, rails, or metal pallet. In other examples, the drill rig 100 is supported by a pair of continuous tracks and includes a drive system 104 that allows the drill operator 10*a* to maneuver and drive the drill rig 100. In some examples, the drill rig 100 includes the drill anchor 102 that anchors the drill rig 100 into the earth 20 and prevents it from moving while drilling the bore 110.

The spool system 210 has a spool of coiled tube 200 (also referred to as a drill tube 200). The spool system 210 is configured to allow a first end 201 of the drill tube 200 to attach to a drill bit 120 and a second end 203 to connect to the hose 136 connected to the fluid tank 130. Therefore, the drill tube 200 allows for the fluid 132 to continuously flow from the fluid tank 130 to the bore 110 while drilling. As previously mentioned, the drilling fluid tank 130 provides drilling fluid 132 to the drilling rig 100. In some examples, the drilling fluid tank 130 includes a pump 134 that pumps fluid through the hose connecting to the drill tube 200. The drilling fluid 132 goes through the spooled drill tube 200 until it reaches the first end 201 of the drill tube 200 that is connected to the drill bit 120. Therefore, using a drill tube 200 (FIG. 2) instead of the drill pipes 140 (FIG. 1) provides a continuous flow of fluid 132 to the drill bit 120 without having to stop and attach a drill pipe 140 when another drill pipe 140 is inserted into the earth 20. The spool system 210 includes a spool support 212 that supports the spool system 210 on the drilling rig 100. In some examples, the spool system 210 is part of the drill rig 100 and the spool system 210 is releasably detachable from the spool support 212; while in other examples, the spool support 212 is part of the spool system 210 and releasably detachable from the drill rig 100.

In some implementations, a sonde housing 300 includes a first end 302 coupled to the drill tube 200 that extends back to the drill rig 100 and a second end 304 coupled to the drill bit 120. The sonde housing 300 includes a sonde 310. The sonde 310 is an instrument used to determine conductivity, temperature, and depth. The sonde 310 includes a cluster of sensors, which measure conductivity, temperature, and pressure. The sonde 310 may include gyroscopes, magnetometers, and accelerometers, which may allow the controller 106 to calculate the drill bit position by dead reckoning. The sensors are arranged inside the sonde housing 300. The sonde 310 may be in electrical or optical communication with a controller 106 on the drill rig 100, and communicates with the controller 106. The controller 106 is in communication with a user interface 108 that includes a display 109. The display 109 displays a graphical user interface (GUI) indicative of the received sensor signals.

In some examples, the drill bit 120 includes one or more sensors 122 in addition or as an alternate to the sonde 310 in the sonde housing 300. A drill operator 10*b* may use a walk-over tracker 320 on the ground surface 22 to track the sensors 122, 310 located in either the drill bit 120 or the sonde housing 300. In some examples, the sonde housing 300 or the drill bit 120 includes a transmit sensor 122, 310, and the walk-over tracker includes a receiver 322 to locate the drill bit 120 or the sonde housing 300 by receiving a transmit signal 321 from one of the transmit sensors 122, 310. In some examples, the walk-over tracker 320 determines the orientation and depth of the transmitter sensor 122, 310 based on the received transmit signal 321. In other examples, the walk-over tracker 320 determines the orientation and depth of the drill bit 120 relative to a position of the machine, rather than using the transmit signal 321 from the sonde 310. By knowing the orientation and depth of the drill bit 120 and the location of underground objects, such as pipes and/or obstacles sensed by the sonde 310, the drill operator 10*b* and/or the walk-over tracker 320 (via a controller) can navigate the drill bit 120 along a desired path.

In some examples, a drilling motor (not shown) is positioned behind the drill bit 120 and is powered by the drill tube 200 (i.e., by power lines 232*a* (electric and/or hydraulic power) within the drill tube 200). The drilling motor may provide higher rotational velocities and rates of penetration in comparison to non-electrical motors. In addition, the drilling motor decreases the weight applied on the drill bit 120.

FIGS. 3A-3E show cross-sectional views of example drill tubes 200, 200*a*-200*d*. The drill tube 200, 200*a*-200*d* includes a drill tube wall 204 having an outer surface 206*o* and an inner surface 206*i*. The inner surface 206*i* defines a drill tube lumen 202 (also referred to as a channel 202, such as a tubular shaped channel) that is configured to receive one or more conduits. A fluid conduit 220 defines a fluid channel 222 that allows for the flow of fluid 132 from the fluid tank 130 to the drill bit 120. The fluid 132 is used to cool down the drill bit 120, carry out the cuttings to the ground surface 22 or the trench 112, and condition the bore 110 so it does not collapse on the drill tube 200. Routing the fluid 132 through and containing the pressurized fluid 132 within the fluid conduit 220 inside the drill tube 200 allows the drill tube 200 itself to have relaxed design constraints, such as having a lower internal pressure rating than the fluid conduit 220, which may be rated for the internal pressure caused by flow of the fluid 132. In other words, the fluid conduit 220 contains the pressurized fluid 132 and the fluid conduit 220 is housed within the drill tube 200. Therefore, the drill tube 200 itself does not need to be configured to withstand the pressure of the fluid 132. Instead, the fluid conduit 220 is configured to withstand the pressure of the fluid 132.

Figure 3A:
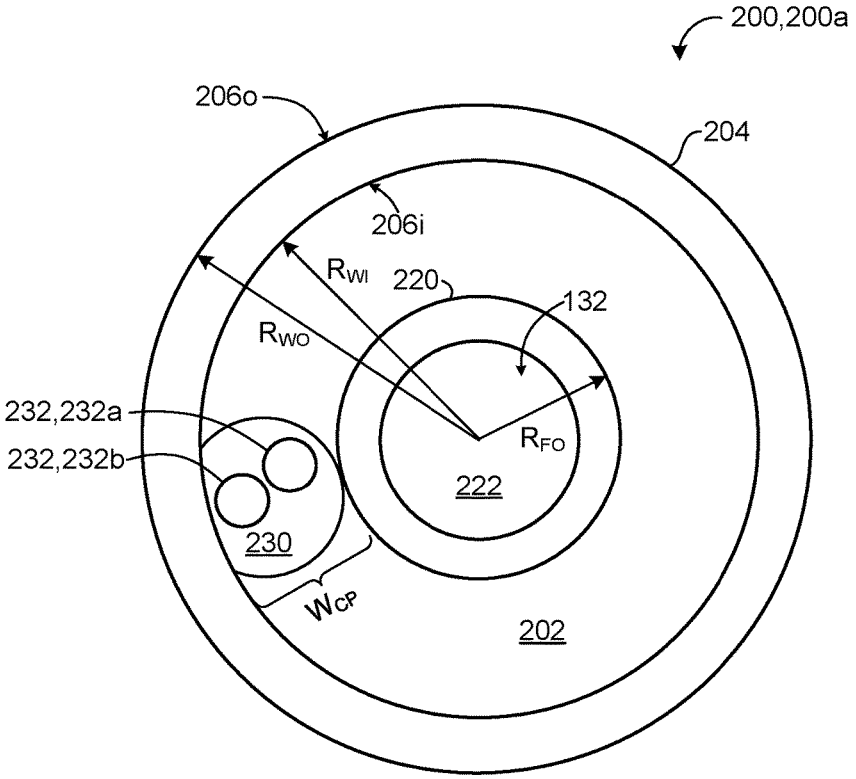
FIGS. 3A-3E are schematic sectional views of example coiled tubing.

Referring to FIG. 3A, in some implementations the drill tube 200, 200*a* includes a power/communication conduit 230 that includes one or more power and/or communication wires 232. In the example shown, the power/communication conduit 230 includes a power line 232*a* (electric and/or hydraulic power) that provides power to the drill bit 120 or the electrical drilling motor that rotates the drill bit 120 and/or a communication wire 232*b* for communicating with the sonde 310 and/or the sensors 122 of the drill bit 120. The drill tube wall 204 has an outer radius $R_{WO}$ and an inner radius $R_{WI}$. The fluid conduit 220 has an outer radius $R_{FO}$, and the power/communication conduit 230 has a cross-sectional width $W_{CP}$ along the inner radius $R_{WI}$ of the drill tube wall 204. In some implementations, the inner radius $R_{WI}$ of the drill tube wall 204 is greater than the outer radius $R_{FO}$ of the fluid conduit 220 plus the cross-sectional width $W_{CP}$ of the power/communication conduit 230.

Figure 3B:
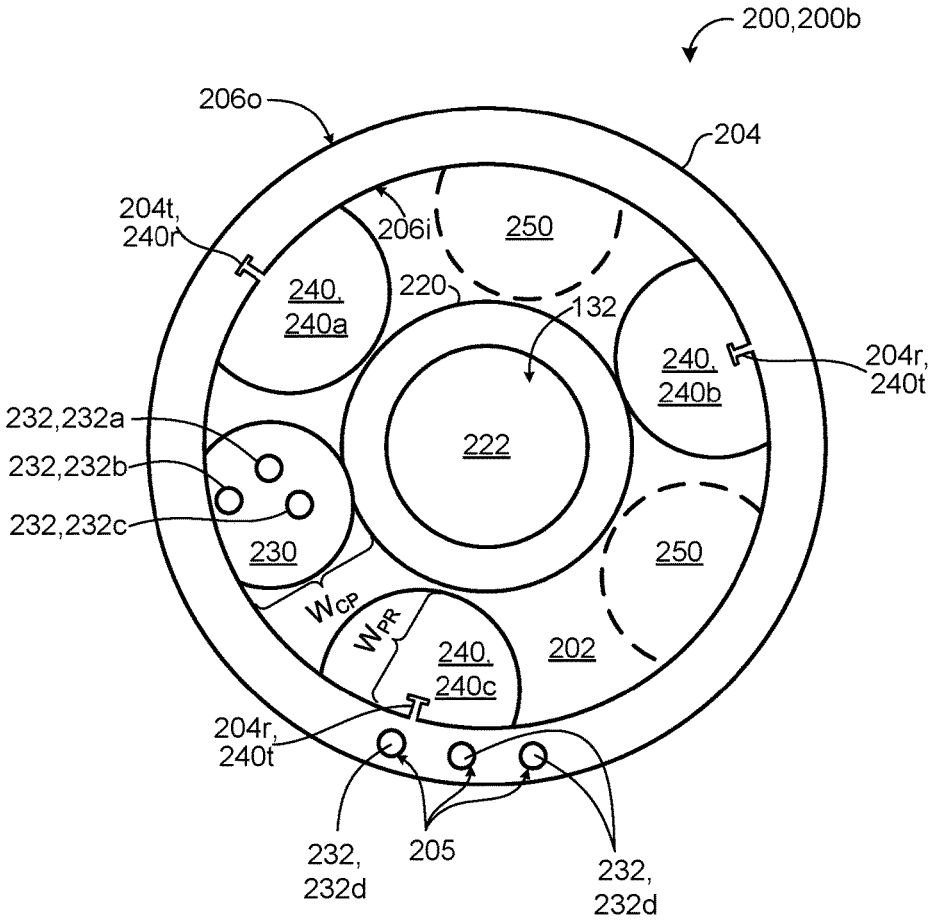

Referring to FIG. 3B, in some implementations the drill tube 200, 200*b* includes the power/communication conduit 230, which includes one or more power lines 232*a* and/or one or more communication wires 232*b*. In some examples, the power/communication conduit 230 includes one or more power/communication wires 232*c* that deliver both power and communications, such as power of Ethernet (PoE). In addition or alternatively, the power line(s) 232*a*, the communication wire(s) 232*b*, and/or the power/communication wire(s) 232*c* are embedded in the drill tube wall 204 of the drill tube 200 between the outer surface 206*o* and the inner surface 206*i*, as embedded wires 232*d*. In other words, the drill tube wall 204 may define one or more utility lumens 205 configured to receive corresponding wires, such as the power line(s) 232*a*, the communication wire(s) 232*b*, and/or the power/communication wire(s) 232*c*.

The power line(s) 232*a* provide power to the drill bit 120 or the electrical drilling motor that rotates the drill bit 120, allowing it to drill through the earth 20. The communication wire(s) 232*b* link communications between the sonde 310 and/or the sensors 122 of the drill bit 120 and the drill rig 100 (e.g., from/to the controller 106). For example, the communication wire(s) 232*b* transmit signals between the drill rig 100 (e.g., from/to the controller 106) and the sonde 310 and/or the sensors 122 of the drill bit 120. In some examples, the communication wire 232 is an optical fiber cable. The optical fiber cable contains one or more optical fibers configured to convey light. The optical fiber elements are typically individually coated with plastic layers and housed in a protective tube based on the environment in which the optical fiber cable may be used.

In some examples, the tubular shaped channel 202 of the drill tube 200 houses push rods 240, 240*a*-240*c*. The push rods 240 may be made of steel, pultruded composite (e.g., fiber or fiberglass), or any other material configured to be bendable with the drill tube 200. The push rods 240 aid pushing the drill bit 120 into the earth 20. In some implementations, the inner radius $R_{WI}$ of the drill tube wall 204 is greater than the outer radius $R_{FO}$ of the fluid conduit 220 plus the largest of the cross-sectional width $W_{CP}$ of the power/communication conduit 230 (e.g., the cross-sectional width of any power line 232*a* and/or any communication wire 232*b*) or a cross-sectional width $W_{PR}$ of any push rod 240.

Figure 4A:
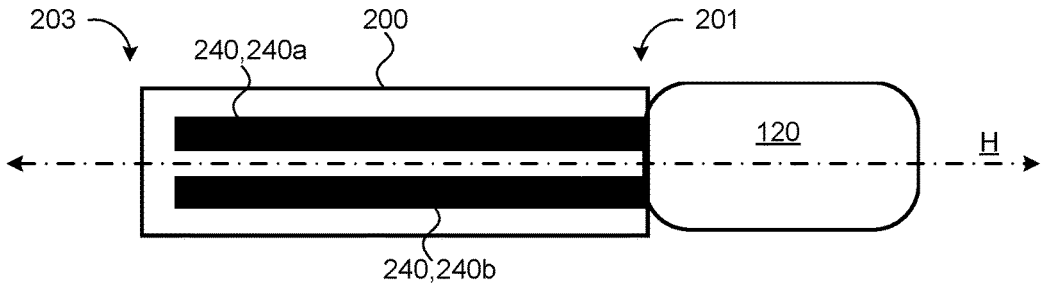
FIGS. 4A and 4B are schematic views of an example coiled tubing having push rods used to maneuver a drill bit.
Figure 4B:
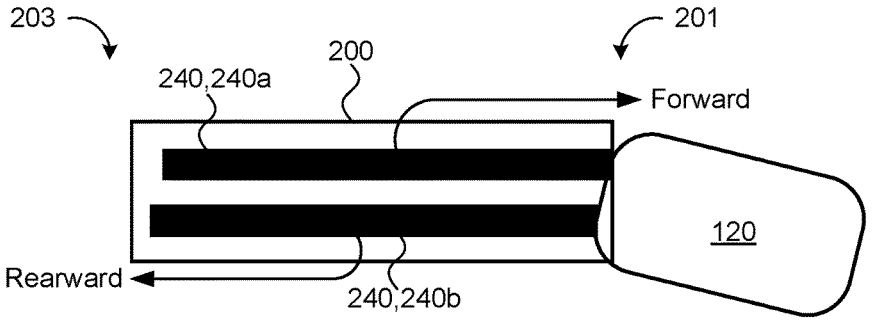

In the examples shown in FIGS. 4A and 4B, the push rods 240 steer the drill bit 120. Therefore, the push rods 240 are configured to move in a forward or backward position with respect to a horizontal axis H extending from the first end 201 of the drill tube 200 to the second end 203 of the drill tube 200.

Referring again to FIGS. 3B-3D, as shown with respect to a first push rod 240*a* and a third push rod 240*c*, the inner surface 206*i* of the drill tube wall 204 defines a trench 204*t* (e.g., a "T" shaped recess) and the push rod 240*a*, 240*c* includes a ridge 240*r* having a complimentary shape as the trench 204*t* defined by the inner surface 206*i* of the drill tube wall 204. The trench 204*t* and ridge 240*r* combination allows the rod 240 to move forward and backward with respect to the horizontal axis H. In additional examples, as shown with respect to a second push rod 240*b*, the push rod 240 defines a trench 240*t* and the inner surface 206*i* of the drill tube wall 204 includes a ridge 204*r*. Similarly, the trench 240*t* and ridge 204*r* combination allows the rod 240 to move forward and backward with respect to the horizontal axis H. As shown, the push rods 240 are shaped to fit in cross-section within a volume of space enveloped by the inner surface 206*i* of the drill tube wall 204. In some examples, the inner surface 206*i* of the drill tube wall 204 is flush with the push rod 240, as shown from the cross-sectional view.

In some implementations, the drill tube 200 includes support conduits or wires 250 that are used to support the other conduits 220, 230 or push rods 240 from moving around within the tubular shape channel 202. The drill tube 200 may have an outer diameter between 25 millimeters and 102 millimeters (e.g., 86 millimeter). The fluid conduit 220 may have an outer diameter between 25 millimeters and 51 millimeters (e.g., 36.5 millimeters). Moreover, the power/communication conduit 230 may have an outer diameter between about 10 millimeters and 50 millimeters (e.g., 20.7 millimeter).

Figure 3C:
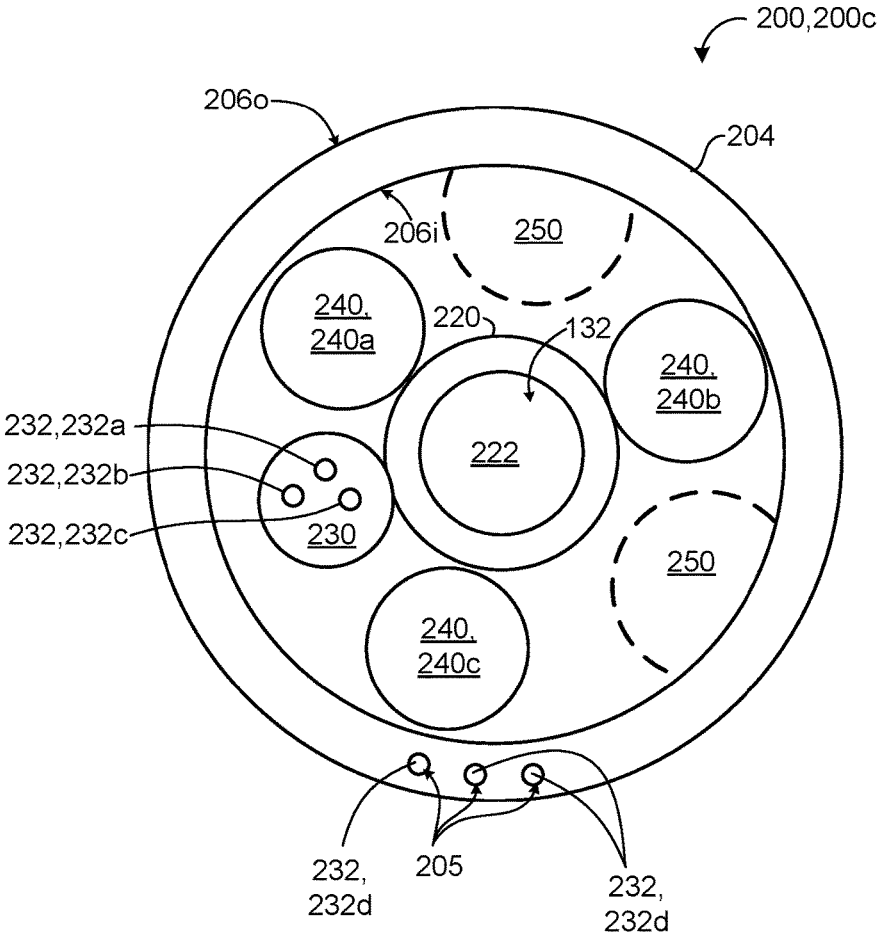

The drill tube 200, 200*c* of FIG. 3C, is similar to the drill tube of FIG. 3B with the exception of the shape of the push rods 240, 240*a*-240*c* (among other possible features). The push rods 240, 240*a*-240*c* are circular in cross-section. As shown, the push rods 240 do not include a trench 204*t*, 240*t* and ridge 204*r*, 240*r*; however, the push rods 240 may include the trench 204*t*, 240*t*/ridge 204*r*, 240*r* combination as described with respect to FIG. 3B. The drill tube 200*c* may have an outer diameter between about 100 millimeters and 130 millimeters (e.g., 106 millimeters).

Figure 3D:
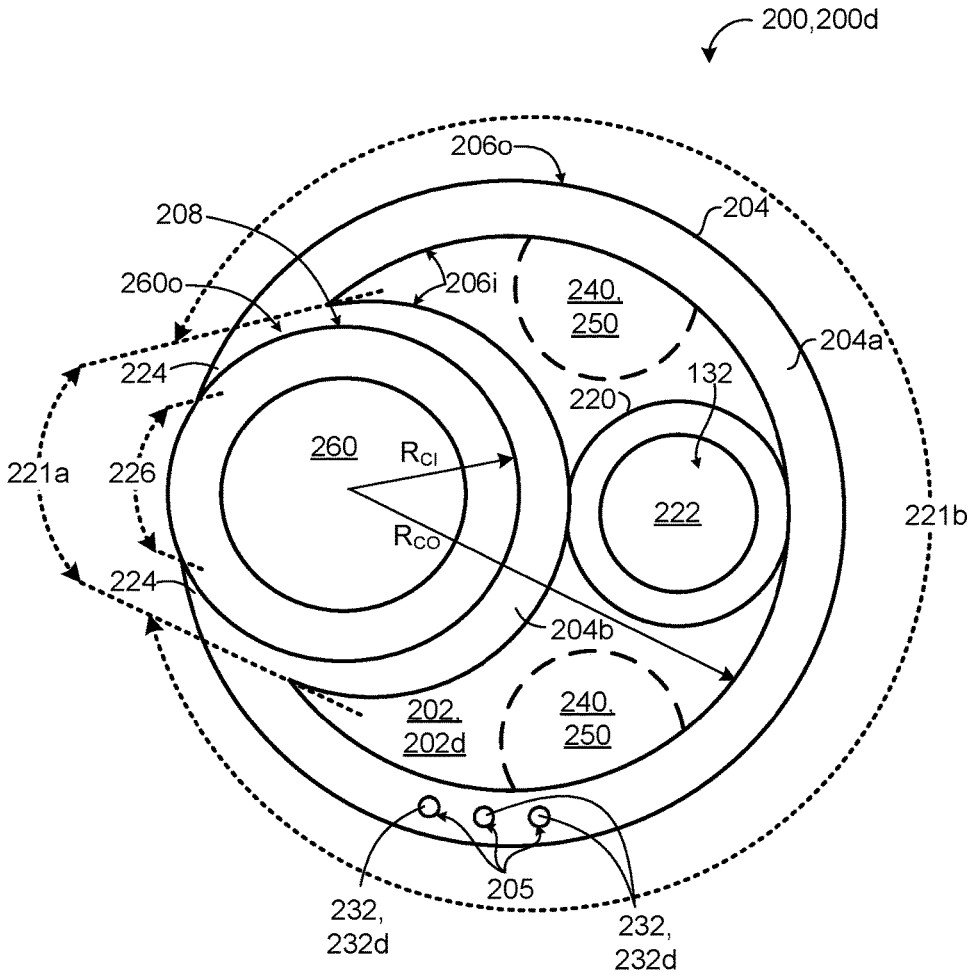

Referring to FIG. 3D, the drill tube 200*d* includes a drill tube wall 204 having an inner surface 206*i* and an outer surface 206*o* that define corresponding first and second crescent-like shapes 221*a*, 221*b*, where the first crescent-like shape 221*a* is smaller than the second crescent-like shapes 221*b*. In the example shown, the drill tube wall 204 includes a first wall 204*a* defining the first curved shape 221*a* having a first radius of curvature $R_{CO}$ and a second wall 204*b* defining the second curved shape 221*b* having a second radius of curvature $R_{CI}$ less than the first radius of curvature $R_{CO}$. An end 224 of the first crescent-like shape 221*a* overlaps with an end 224 of the second crescent-like shape 221*b*. The first and second crescent-like shapes 221*a*, 221*b* of the drill tube 200*d* allow the inner surface 206*i* of the drill tube wall 204 to define a crescent-shaped channel 202*d* (in cross-section) therethrough and a longitudinal recess 208 configured to receive one or more conduits. For example, the first crescent-like shape 221*a* is configured to receive a conduit 260 through an opening 226 defined between the ends 224 of the first and second crescent-like shapes 221*a*, 221*b* of the drill tube 200. The conduit 260 may have a shape that is partially complementary to the shape of the first crescent-like shape 221*a* of the drill tube 200. Moreover, the opening 226 may be smaller than an outer diameter of the conduit 260, so as to releasably retain an outer surface 260*o* of the conduit 260 against the first crescent-like shape 221*a* of the outer surface 206*o* of the drill tube wall 204. Therefore, in some examples, the conduit 260 is configured to be released from the drill tube 200*d* and remain in the pilot bore 110 and be used for communications.

In some examples, after the drill bit 120 reaches the second end of the pilot bore 110, the drill bit 120 is configured to backtrack from the second end to the first end 110*a* of the pilot bore 110, and squeeze the conduit 260 out of the drill tube 200*d* as the drill bit 120 is moving backwards. In additional examples, when the drill bit 120 reaches the second end of the pilot bore 110, the drill operator 10 replaces the drill bit with a peeling tool (not shown) that peels the drill tube 200 from the conduit 260, as the conduit remains in the pilot bore 110 and the drill tube 200 retracts on the spool system 210. The drill operator 10 may attach the conduit 260 to a conduit holder (not shown) at the second end of the pilot bore 110 to help keep the conduit within the pilot bore 110. In yet additional examples, the drill tube 200*d* may slide off of the conduit 260 instead of peeling off. A reamer is sometimes not needed, since the pilot bore 110 is large enough to fit the conduit 260. Once the drill tube 200*d* is peeled off or slid off of the conduit 260, communication cables (e.g., optical fiber cables) may be inserted through the conduit 260. The conduit 260 may include a string (not shown) that is used to pull the communication cables from one end of the conduit 260 to the opposite end. In some examples, the conduit 260 has an outer diameter between about 38 millimeters and 50 millimeters (e.g. 45 millimeters). The drill tube 200*d* may have an outer diameter of about 82 millimeters and 95 millimeters (e.g., 86 millimeters). The drill tube 200*d* may include push rods 240 and/or support conduits or wires 250.

Figure 3E:
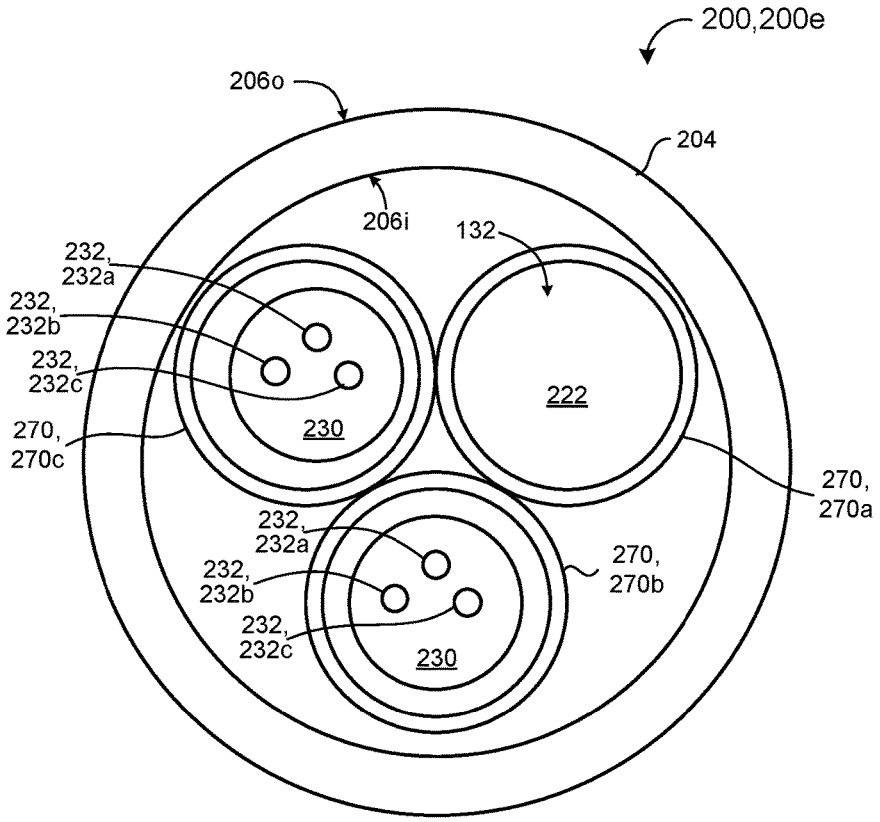

Referring to the example shown in FIG. 3E, in some implementations, the drill tube 200*e* includes first, second, and third conduits 270, 270*a*-270*c*. As shown, the conduits 270 have the same outer diameter, but in other examples the conduits may each have an outer diameter different than another or both other outer diameters. Each conduit 270 may have an outer diameter of about 25 millimeters to about 38 millimeters (e.g., 31.75 millimeters). In some examples, the first conduit 270*a* is a fluid conduit 220 that transmits the fluid 132 from the drill rig 100 to the drill bit 120. The second and third conduits 270*b*, 270*c* may be used for power and communication. For example, the second conduit 270*b* may include three 8-gauge wires for providing communication and or power to the drill bit 120. The third conduit 270*c* may include fiber optic communication wires 232*b* that allow for communication between the sensors 122 on the drill bit 120 and the controller 106. In some examples, the outer diameter of the conduits 270 is between about 88 millimeters and 108 millimeters.

The configurations and/or arrangements of components of the various examples of drill tubes 200*a*-200*e* described with reference to FIGS. 3A-3E may be combined or interchanged to provide additional configurations of drill tubes 200. For example, the crescent-shaped drill tube 200*d* may include the power/communication conduit 230 of the example drill tube 200*b* shown in FIG. 3B. Additionally or alternatively, the crescent-shaped drill tube 200*d* may include an arrangement of one or more power lines 232*a* and/or one or more communication wires 232*b* housed in the crescent-shaped channel 202*d*. Other combinations of features between the examples shown are possible as well.

Referring to FIGS. 4A and 4B, in some implementations and as previously described, the push rods 240 are used to maneuver the drill bit 120. Referring to FIG. 4A, when the push rods 240 are moving adjacent to one another, the drill bit 120 moves in a forward direction. However, if a first push rod 240*a* is pushed in a forward direction or a second push rod 240*b* is pushed in a backward direction, then the drill bit 120 moves in the direction of the second push rod 240*b* as shown in FIG. 4B. As shown in FIGS. 4A and 4B, only two push rods 240*a*, 240*b* are shown, but a drill tube 200 may include more than two push rods 240 allowing the drill bit to rotate in an up/down, left/right, or a combination thereof motions. In some examples, the drill rig 100 includes a hydraulic cylinder (also known as a hydraulic motor) (not shown) that is used to manipulate and maneuver the push rods 240. The hydraulic cylinder provides unidirectional force by applying a unidirectional stroke to the push rods 240.

In some examples, due to the drill tube 200 being spooled on the spool system 210 and having a tight bend radius, a push rod 240 on an outer curvature of the drill tube 200 is either expanded or shorter. Therefore, when manipulating the push rods 240 to maneuver the drill bit 120, the curvature of the drill tube 200 is considered and accounted for in the calculations for maneuvering the drill bit 120.

Figure 5A:
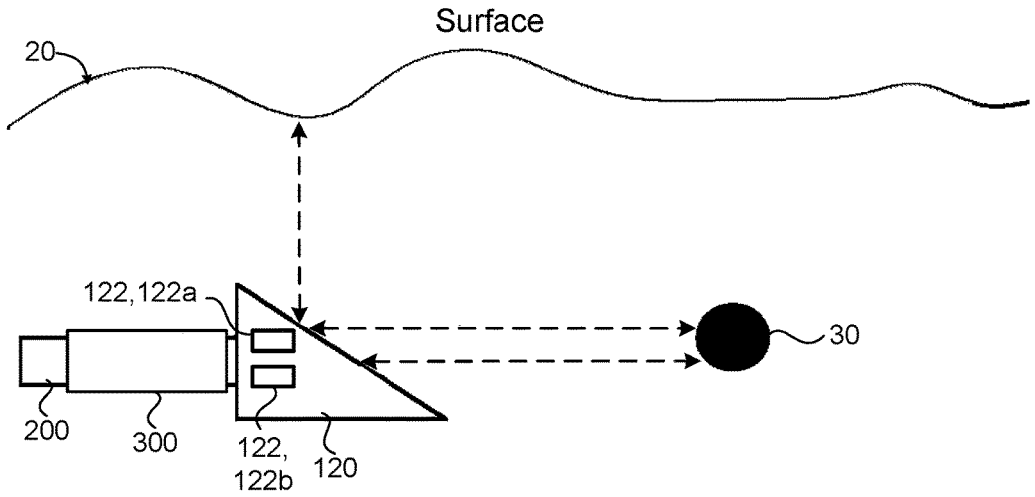
FIG. 5A is a schematic view of an example coiled tubing having sensors.
Figure 5B:
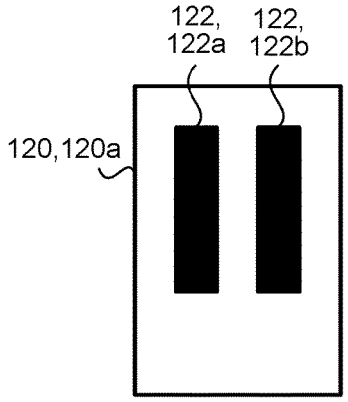
FIGS. 5B and 5C are schematic views of example drill bits having sensors.
Figure 5C:
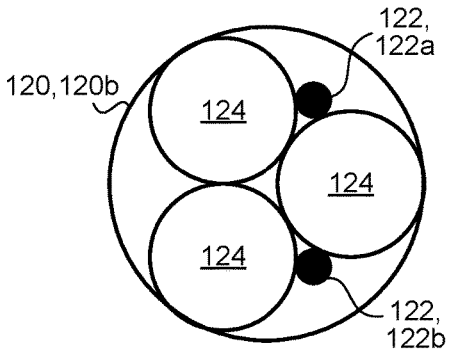

Referring to FIGS. 5A-5C, in some implementations the drill bit 120 includes sensors 122 to determine depth, collisions detection, or other determinations. Referring to FIG. 5A, the drill bit 120 includes two sensors 122, one sensor 122 for detecting depth and the other sensor 122 for detecting objects 30 within the drill path 114 of the drill bit 120. When an object 30 is detected, the drill operator 10 changes the direction of the drill bit 120 to steer away from the object 30. The drill operator 10 chooses a new drill path 114 and can pull the drill bit 120 back if needed. In some examples, due to the rotation of the drill bit 120, the sensors 122 provide a radial scan, thus they emit a signal from more than one position, where the position is moving in a circular motion.

A sensor may be a radar sensor, an ultrasound sensor, or any other object detection system. A radar sensor uses radio waves to determine the range, angle, or velocity of objects. A radar sensor transmits radio waves or microwaves that reflect from an object in its path. The radar sensor receives and processes the reflected waves to determine properties of the object. An ultrasound sensor uses sound waves with frequencies higher than the upper audible limit of human hearing. The ultrasound sensor is used to detect an object a distance from the ultrasound sensor to the object 30. In some examples, the sensors transmit pulse signals. A sonic sensor is typically within audible limits of human hearing (e.g., down to 3 kHz). The sensor 122 may be a homing beacon that is a radio or acoustic device allowing the drill operator 10 to track the drill bit 120 supporting the sensor 122. In some implementations, dead reckoning is used (by the controller 106) to calculate the position of the drill bit 120 supporting the sensor 122 by using a previously determined position, or fix, and advancing that position based on a known or estimated speed over elapsed time and course. Time of flight (TOF) describes a variety of methods that measure the time it takes for an object, particle or acoustic, electromagnetic or other wave to travel a distance through a medium (in this case the earth 20). TOF may be used by the sensors 122 to determine the depth, distance, or composition of an object 30.

FIG. 5B is a front view of a spade-shaped drill bit 120, 120*a* that includes first and second sensors 122, 122*a*, 122*b*. FIG. 5C is a front view of a roller-cone shaped drill bit 120, 120*b* having three drill rollers 124 and two sensors 122. Referring to both FIGS. 5A and 5C, in some examples the first sensor 122*a* is a radar sensor and the second sensor is an ultrasound sensor. Other combinations are possible as well.

Figure 6:
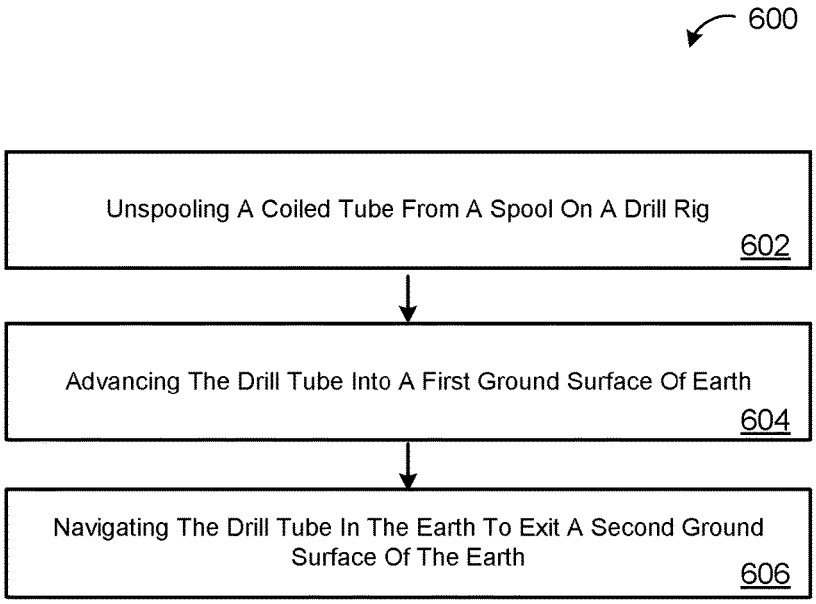
FIG. 6 is a schematic view of an example arrangement of operations for a method of drilling.

FIG. 6 illustrates a method 600 for drilling. In some implementations, at block 602, the method 600 includes unspooling a coiled drill tube 200 from a spool system 210 on a drill rig 100, at block 604, advancing the drill tube 200 into a first ground surface 22*a* of earth 20, and at block 606, navigating the drill tube 200 in the earth 20, for example, to exit a second ground surface 22*b* of the earth 20.

In some implementations, the drill tube 200 includes a drill tube 200, a fluid conduit 220, and at least one of a communication wire 232*b* or a power line 232*a*. The drill tube 200 defines a longitudinal axis L and includes a tubular wall 204 forming a drill tube lumen 202 along the longitudinal axis L. The fluid conduit 220 is housed in the drill tube lumen 202 and extends along the longitudinal axis L. The fluid conduit 220 is configured to convey a fluid 132 therethrough. The drill tube 200 has a first end 201 releasably connectable to a drill bit 120 having a sensor 122 and a second end 203 releasably connectable to a drill rig 100. The at least one of the communication wire 232*b* or the power line 232*a* is housed in the drill tube lumen 202 adjacent the fluid conduit 220. The communication wire 232*b* is configured to provide communication between the sensor 122 of the drill bit 120 and the drill rig 100. The power line 232*a* is configured to deliver power from the drill rig 100 to the drill bit 120. In some examples, the tubular wall 204 optionally defines at least one utility lumen 205 along the longitudinal axis L that houses a power or communication line 232, 232*a-d*.

In additional implementations, the drill tube 200 includes a drill tube wall 204 having a crescent cross-sectional shape and defining a longitudinal axis L. The drill tube 200 includes a first wall 204*a* defining a first curved shape 221*a* having a first radius of curvature $R_{CI}$ and a second wall 204*b* defining a second curved shape 221*b* having a second radius of curvature $R_{COI}$ less than the first radius of curvature $R_{CO}$. The first and second walls 204*a*, 204*b* are joined and collectively form a drill tube lumen 202, 202*d* having a crescent cross-sectional shape along the longitudinal axis L. The drill tube 200 has a first end 201 releasably connectable to a drill bit 120 and a second end 203 releasably connectable to the drill rig 100. The second wall 204*b* defines a longitudinal recess 208 of the drill tube 200, 200*d* having a partially circular cross-section and configured to receive and releasable retain a conduit 260. The drill tube 200 also includes a fluid conduit 220 housed in the drill tube lumen 202, 202*d* and extending along the longitudinal axis L. The fluid conduit 220 is configured to convey a fluid 132 therethrough. The drill tube 200 optionally includes at least one of a communication wire 232*b* or a power line 232*a* housed in the drill tube lumen 202, 202*d* adjacent the fluid conduit 220 and adjacent any optional push rod 240. The communication wire 232*b* is configured to provide communication between a sensor 122 of the drill bit 120 and the drill rig 100. The power line 232*a* is configured to deliver power from the drill rig 100 to the drill bit 120.

In some implementations, navigating the drill tube 200 includes manipulating at least one push rod 240 housed in the drill tube lumen 202 adjacent the fluid conduit 220. The at least one push rod 240 may be connected to the first end 201 of the drill tube 200.

The tubular wall 204 may have an outer radius $R_{WO}$ and an inner radius $R_{WI}$. The fluid conduit 220 may have an outer radius $R_{FO}$. Moreover, the at least one push rod 240, the communication wire 232*b*, and the power line 232*a*, each has a cross-sectional width $W_{PR}$, $W_{CP}$ along the inner radius $R_{WI}$ of the tubular wall 204. The inner radius $R_{WI}$ of the tubular wall 204 may be greater than the outer radius $R_{FO}$ of the fluid conduit 220 plus a largest of the cross-sectional width $W_{PR}$, $W_{CP}$ of any of the at least one push rod 240, the communication wire 232*b*, and the power line 232*a*. The tubular wall 204 may have an inner surface 206*i* defining a longitudinal track 204*r* that receives and guides movement of the at least one push rod 240. The at least one push rod 240 may define a longitudinal recess having a shape complimentary to the longitudinal track. Additionally or alternatively, the tubular wall 204 may define a longitudinal recess 204*t* configured to receive and guide movement of the at least one push rod 240 (e.g., via a push rod track 240*r*). For example, the at least one push rod 240 may define a longitudinal track 240*r* having a shape complimentary to the longitudinal recess 204*t*.

In some examples, the at least one push rod 240 includes a steel material or a pultruded composite material. The drill tube 200 may also include at least one support 250 housed in the drill tube lumen 202 and extending along the longitudinal axis L. The support 250 may support the fluid conduit 220 and/or the at least one of the communication wire 232*b* or the power line 232*a*. The drill tube 200 may further include a power/communication conduit 230 housed in the drill tube lumen 202 adjacent the fluid conduit 220. The power/communication conduit 230 may house the at least one of the communication wire 232*b* or the power line 232*a*.

In some examples, the tubular wall 204 has an outer diameter between 25 millimeters and 102 millimeters. The fluid conduit 220 may have an outer diameter between about between 25 millimeters and 51 millimeters. The power/communication conduit 230 may have an outer diameter between about 10 millimeters and 50 millimeters. Moreover, the communication wire 232*b* may include an optical fiber for transmitting an optical communication.

Figure 7:
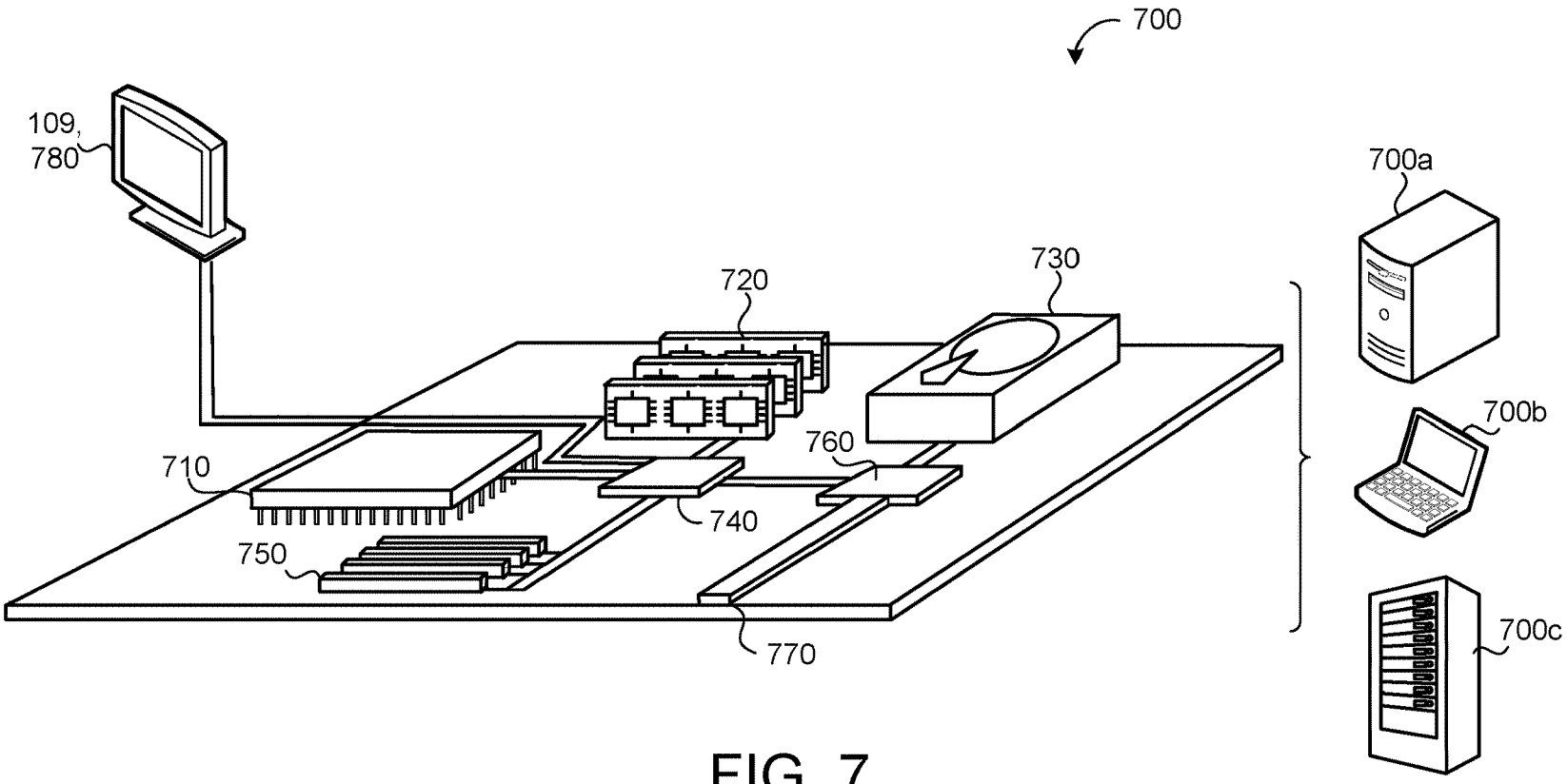
FIG. 7 is a schematic view of an example computing device executing any systems or methods described herein.

FIG. 7 is schematic view of an example computing device 700 (e.g., controller 106) that may be used to implement the systems and methods described in this document. For example, the drilling rig 100 may include a computing device 700. The computing device 700 is intended to represent various forms of digital computers, such as mobile devices, laptops, tablets, desktops, workstations, personal digital assistants, servers, blade servers, mainframes, and other appropriate computers. The components shown here, their connections and relationships, and their functions, are meant to be exemplary only, and are not meant to limit implementations of the inventions described and/or claimed in this document.

The computing device 700 includes a processor 710, memory 720, a storage device 730, a high-speed interface/controller 740 connecting to the memory 720 and high-speed expansion ports 750, and a low speed interface/controller 760 connecting to low speed port 770 and storage device 730. Each of the components 710, 720, 730, 740, 750, and 760, are interconnected using various busses, and may be mounted on a common motherboard or in other manners as appropriate. The processor 710 can process instructions for execution within the computing device 700, including instructions stored in the memory 720 or on the storage device 730 to display graphical information for a graphical user interface (GUI) on an external input/output device, such as display 780 coupled to high speed interface 740. In other implementations, multiple processors and/or multiple buses may be used, as appropriate, along with multiple memories and types of memory. Also, multiple computing devices 700 may be connected, with each device providing portions of the necessary operations (e.g., as a server bank, a group of blade servers, or a multi-processor system).

The memory 720 stores information non-transitorily within the computing device 700. The memory 720 may be a computer-readable medium, a volatile memory unit(s), or non-volatile memory unit(s). The non-transitory memory 720 may be physical devices used to store programs (e.g., sequences of instructions) or data (e.g., program state information) on a temporary or permanent basis for use by the computing device 700. Examples of non-volatile memory include, but are not limited to, flash memory and read-only memory (ROM)/programmable read-only memory (PROM)/erasable programmable read-only memory (EPROM)/electronically erasable programmable read-only memory (EEPROM) (e.g., typically used for firmware, such as boot programs). Examples of volatile memory include, but are not limited to, random access memory (RAM), dynamic random access memory (DRAM), static random access memory (SRAM), and phase change memory (PCM).

The storage device 730 is capable of providing mass storage for the computing device 700. In some implementations, the storage device 730 is a computer-readable medium. In various different implementations, the storage device 730 may be a floppy disk device, a hard disk device, an optical disk device, or a tape device, a flash memory or other similar solid state memory device, or an array of devices, including devices in a storage area network or other configurations. In additional implementations, a computer program product is tangibly embodied in an information carrier. The computer program product contains instructions that, when executed, perform one or more methods, such as those described above. The information carrier is a computer- or machine-readable medium, such as the memory 720, the storage device 730, or memory on processor 710.

The high speed controller 740 manages bandwidth-intensive operations for the computing device 700, while the low speed controller 760 manages lower bandwidth-intensive operations. Such allocation of duties is exemplary only. In some implementations, the high-speed controller 740 is coupled to the memory 720, the display 780 (e.g., through a graphics processor or accelerator), and to the high-speed expansion ports 750, which may accept various expansion cards (not shown). In some implementations, the low-speed controller 760 is coupled to the storage device 730 and low-speed expansion port 770. The low-speed expansion port 770, which may include various communication ports (e.g., USB, Bluetooth, Ethernet, wireless Ethernet), may be coupled to one or more input/output devices, such as a keyboard, a pointing device, a scanner, or a networking device, such as a switch or router, e.g., through a network adapter.

The computing device 700 may be implemented in a number of different forms, as shown in the figure. For example, it may be implemented as a standard server 700*a* or multiple times in a group of such servers 700*a*, as a laptop computer 700*b*, or as part of a rack server system 700*c*.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A drill coil comprising:

a drill tube defining a longitudinal axis and having a first end releasably connectable to a drill bit having a sensor and a second end releasably connectable to a drill rig, the drill tube comprising a tubular wall forming a drill tube lumen that extends along the longitudinal axis from the first end of the drill tube to the second end of the drill tube, the tubular wall defining at least one utility lumen that extends along the longitudinal axis from the first end of the drill tube to the second end of the drill tube;

a fluid conduit housed in the drill tube lumen and extending along the longitudinal axis, the fluid conduit configured to convey a fluid therethrough;

a power/communication conduit housed in the drill tube lumen adjacent the fluid conduit and extending along the longitudinal axis from the first end of the drill tube to the second end of the drill tube, the power/communication conduit housing at least one of a first communication wire or a first power line, the first communication wire configured to provide communication between the sensor of the drill bit and the drill rig, and the first power line configured to deliver power from the drill rig to the drill bit; and a second power line or a second communication wire disposed in the at least one utility lumen, wherein the power/communication conduit has a cross-sectional width, the fluid conduit has an outer radius, and the tubular wall has an outer radius and an inner radius defining the drill tube lumen, the inner radius of the tubular wall greater than the outer radius of the fluid conduit plus the cross-sectional width of the power/communication conduit.

2. The drill coil of claim 1, further comprising at least one push rod housed in the drill tube lumen adjacent the fluid conduit, the at least one push rod connected to the first end of the drill tube.

3. The drill coil of claim 2, wherein the at least one push rod has a cross-sectional width along the inner radius of the tubular wall, the inner radius of the tubular wall is greater than the outer radius of the fluid conduit plus a largest of the cross-sectional width of any of the at least one push rod and the power/communication conduit.

4. The drill coil of claim 2, wherein the tubular wall has an inner surface defining a longitudinal track that receives and guides movement of the at least one push rod, the at least one push rod defining a longitudinal recess having a shape complimentary to the longitudinal track.

5. The drill coil of claim 2, wherein the tubular wall defines a longitudinal recess configured to receive and guide movement of the at least one push rod, the at least one push rod defining a longitudinal track having a shape complimentary to the longitudinal recess.

6. The drill coil of claim 5, wherein the at least one push rod comprises a steel material or a pultruded composite material.

7. The drill coil of claim 1, further comprising at least one support housed in the drill tube lumen and extending along the longitudinal axis, the support supporting the fluid conduit and the power/communication conduit.

8. The drill coil of claim 1, wherein the outer diameter of the tubular wall is between 25 millimeters and 102 millimeters, the outer diameter of the fluid conduit is between about between 25 millimeters and 51 millimeters, and the power/communication conduit has an outer diameter between about 10 millimeters and 50 millimeters.

9. The drill coil of claim 1, wherein the first communication wire comprises an optical fiber for transmitting an optical communication.

10. A method of drilling, the method comprising:

unspooling a drill coil from a spool on a drill rig, the drill coil comprising:

a drill tube defining a longitudinal axis and having a first end releasably connectable to a drill bit having a sensor and a second end releasably connectable to the drill rig, the drill tube comprising a tubular wall forming a drill tube lumen that extends along the longitudinal axis from the first end of the drill tube to the second end of the drill tube, the tubular wall defining at least one utility lumen that extends along the longitudinal axis from the first end of the drill tube to the second end of the drill tube;

a fluid conduit housed in the drill tube lumen and extending along the longitudinal axis, the fluid conduit configured to convey a fluid therethrough;

a power/communication conduit housed in the drill tube lumen adjacent the fluid conduit and extending along the longitudinal axis from the first end of the drill tube to the second end of the drill tube, the power/communication conduit housing at least one of a first communication wire or a first power line, the first communication wire configured to provide communication between the sensor of the drill bit and the drill rig, and the first power line configured to deliver power from the drill rig to the drill bit; and a second power line or a second communication wire disposed in the at least one utility lumen;

advancing the drill tube into a first ground surface of earth; and navigating the drill tube in the earth to exit a second ground surface of the earth, wherein the power/communication conduit has a cross-sectional width, the fluid conduit has an outer radius, and the tubular wall has an outer radius and an inner radius, the inner radius of the tubular wall greater than the outer radius of the fluid conduit plus the cross-sectional width of the power/communication conduit.

11. The method of claim 10, wherein navigating the drill tube comprises manipulating at least one push rod housed in the drill tube lumen adjacent the fluid conduit, the at least one push rod having a first end connected to the first end of the drill tube.

12. The method of claim 11, and wherein the at least one push rod has a cross-sectional width along the inner radius of the tubular wall, and the inner radius of the tubular wall is greater than the outer radius of the fluid conduit plus a largest of the cross-sectional width of any of the at least one push rod and the power/communication conduit.

13. The method of claim 11, wherein the tubular wall has an inner surface defining a longitudinal track that receives and guides movement of the at least one push rod, the at least one push rod defining a longitudinal recess having a shape complimentary to the longitudinal track.

14. The method of claim 11, wherein the tubular wall defines a longitudinal recess configured to receive and guide movement of the at least one push rod, the at least one push rod defining a longitudinal track having a shape complimentary to the longitudinal recess.

15. The method of claim 11, wherein the at least one push rod comprises a steel material or a pultruded composite material.

16. The method of claim 10, wherein the drill tube further comprises at least one support housed in the drill tube lumen and extending along the longitudinal axis, the support supporting the fluid conduit and the power/communication conduit.

17. The method of claim 10, wherein the outer diameter of the tubular wall is between 25 millimeters and 102 millimeters, the outer diameter of the fluid conduit has is between about between 25 millimeters and 51 millimeters, and the power/communication conduit has an outer diameter between about 10 millimeters and 50 millimeters.

18. The method of claim 10, wherein the first communication wire comprises an optical fiber for transmitting an optical communication.

* * * * *